US006781614B2

(12) United States Patent
Pearson et al.

(10) Patent No.: US 6,781,614 B2
(45) Date of Patent: Aug. 24, 2004

(54) APPARATUS AND METHOD OF PRINTING ON EMBOSSED CARDS

(75) Inventors: Gary L. Pearson, Rosemount, MN (US); PeKarna D. Mathew, Chanhassen, MN (US)

(73) Assignee: DataCard Corporation, Minnetonka, MN (US)

( * ) Notice: Subject to any disclaimer, the term of this patent is extended or adjusted under 35 U.S.C. 154(b) by 44 days.

(21) Appl. No.: 10/172,599

(22) Filed: Jun. 14, 2002

(65) Prior Publication Data

US 2003/0001941 A1 Jan. 2, 2003

Related U.S. Application Data

(60) Provisional application No. 60/298,849, filed on Jun. 15, 2001.

(51) Int. Cl.[7] ..... B41J 2/32

(52) U.S. Cl. ..... 347/171

(58) Field of Search ..... 349/171, 200, 349/205, 206, 223; 400/120.01; 29/611

(56) References Cited

U.S. PATENT DOCUMENTS 4,650,350 A * 3/1987 Dorner ..... 400/120.01
5,701,659 A * 12/1997 Amano ..... 29/611
6,392,682 B2 * 5/2002 Ozawa ..... 347/223

* cited by examiner

*Primary Examiner*—K. Feggins
(74) *Attorney, Agent, or Firm*—Merchant & Gould P.C.

(57) ABSTRACT

A thermal printhead for printing on pre-embossed plastic cards, and a method for making a thermal printhead for printing on pre-embossed plastic cards. The printhead includes a means for connecting to a data source, means for connecting to a power source, a data transfer means, and at least one elongated contact member having at least one notch to allow the thermal printhead to pass over the pre-embossed text during the printing process.

20 Claims, 7 Drawing Sheets

APPARATUS AND METHOD OF PRINTING ON EMBOSSED CARDS

This application claims the benefit of U.S. Provisional Application No. 60/298,849, entitled APPARATUS AND METHOD OF PRINTING ON EMBOSSED CARDS, filed Jun. 15, 2001, and is incorporated herewith by reference in its entirety.

FIELD OF THE INVENTION

This invention is related to an apparatus and method of printing on embossed cards. More particularly this invention is related to a thermal printhead having at least one notch for printing on a pre-embossed surface such as a plastic card, and is related to a method of making a thermal printhead for printing on pre-embossed cards.

BACKGROUND OF THE INVENTION

Plastic cards such as credit cards, identification cards, driver's licenses, access cards, debit cards, insurance cards, and the like are typically printed by thermal printers that utilize thermal transfer technology. Such thermal transfer technology typically is known as dye diffusion thermal transfer (D2T2). The thermal printing process uses thermal energy to transfer a special ink coating onto a substrate, such as a plastic card. The thermally activated ink coating is made up using a wax or resin formulation, or various combinations thereof, and carbon black (in the case of black ink), and is applied from a carrier film or ribbon.

A roll of thermal transfer ribbon (TTR) is loaded into the card printer. Application of the ink is carried out by a ceramic print head, which contains special tiny heating elements that are typically smaller than a grain of sand. These heating elements are paper thin, similar to the traces on a printed circuit board, and are attached to the ceramic print head. Because these elements are so thin, the ceramic print head acts as a heat sink, and has the ability to heat up and cool down very quickly. As the thermal transfer ribbon passes across the face of the print head, the ceramic elements in the print head are energized and the heat produced activates the ink coating, transferring it onto the card. Typically, printheads are connected to a data source that provides image and text data. Further, the contact member or ceramic is employed to make contact with a plastic card during the printing process. One example of this type of printhead is model #KDE-57 made by Kyocera. Simultaneously, data is transferred from the data source through the transfer means and conductive material of the contact member to print the necessary images onto a plastic card.

In addition, these printed cards typically have pre-embossed lettering and numbers, such as names, identification numbers, account numbers, expiration dates, etc. Often a central bank or central card issuer will pre-emboss cards and then send them to branch banks or local issuers who will then print on the card, such as the card holder information and/or branch bank or local issuer information. Currently, thermal printheads have presented a problem for printing on these pre-embossed cards. The contact member or ceramic has been rigidly structured where the pre-embossed text interferes with the conventional flush contact between the plastic card and the thermal printhead needed for printing. Therefore, there is a need for an improved thermal printhead that can print on pre-embossed plastic cards without being obstructed by the pre-embossing of the card, such as pre-embossed text.

SUMMARY OF THE INVENTION

In accordance with the present invention, the above and other problems were solved by providing a notched thermal printhead. Further, a method for making a notched printhead and printing on plastic cards is provided, where the thermal printhead has at least one notch. At least one contact member of the thermal printhead includes a notch that enables pre-embossed regions of a substrate, such as text or pictures, to pass under a notch of the printhead while printing on the substrate, such as a plastic card.

In one embodiment of the present invention, a thermal printhead includes a means for connecting to a data source and a means for connecting to a power source. Further, the thermal printhead includes a data transfer means operatively connected with the means for connecting to a data source for transferring data from the data source. The data transfer means contains at least one elongated contact member operatively connected therewith. The elongated contact member includes a contact surface that contacts a substrate, such as a plastic card, during the printing process. At least one notch is in communication with the contact surface of the elongated contact member, where the notch defines a gap in the contact surface. During the printing process, the notch is positioned to allow an embossed region of the plastic card, such as pre-embossed text, to pass under the thermal printhead where the notch is located. The thermal printhead is allowed to print on the plastic card on at least both sides of the pre-embossed text, while passing over the pre-embossed text at the notch position and maintaining contact with the rest of the card through the contact surface.

In another embodiment, an elongated contact member of a thermal printhead as above may have a plurality of notches where a pre-embossed substrate may have pre-embossed text at positions of the substrate where such text cannot pass under a first notch. Preferably, the notches are disposed along the longitudinal axis on the contact surface of the elongated contact member.

In another embodiment, a plurality of elongated contact members may be attached to a common thermal printhead with a common communication port and power port. The elongated contact members are space apart to create at least one notch resembling a gap or recess so as to enable an embossed region to pass under the printhead at the notch.

In another embodiment, a method for making a thermal printhead includes providing a thermal printhead having a means for connecting to a data source and a means for connecting to a power source, and a data transfer means for transferring image data from the data source. Further, the data transfer means is operatively connected with at least one elongated contact member for contacting a substrate, such as a plastic card. The thermal printhead is retrofitted to a plastic card in order to obtain a position where a notch is to be located. After retrofitting the thermal printhead to the plastic card, a step of notching the thermal printhead is performed, thereby making a groove or recess the size of the pre-embossed text allowing the thermal printhead to print on at least both sides of the pre-embossed text of the plastic card while the pre-embossed text may pass under the groove or recess created by the notch.

In yet another embodiment of the present invention, a method of making a thermal printhead includes providing a thermal printhead having a means for connecting to a data source and power source, and a data transfer means for transferring image data from the data source. Further, an elongated contact member operatively connected with the data transfer means for contacting a plastic card is provided.

The thermal printhead is pre-fitted in accordance with conventional standards for embossed texts on cards. A notch is put into the elongated contact member according to these known positions. A groove at least the size of the pre-embossed text and positioned according to conventional standards allows the thermal printhead to print on at least a surface of the plastic card where there is no pre-embossed text.

In another embodiment of the present invention, a plurality of notches may be applied to an elongated contact member where a pre-embossed plastic card may have pre-embossed text at positions of the plastic card where such text cannot pass under a first applied notch.

In yet another embodiment of the present invention, a method of printing on pre-embossed cards includes providing a thermal printhead having a means for connecting to a data source, and a data transfer means for transferring image data from the data source. Further, an elongated contact member having at least one notch along a length of a contact surface of the data transferring means is provided. The notch is fitted to allow pre-embossed text to pass under the printhead during the printing process. Plastic cards are pre-embossed with text and supplied to a card processing station. The card processing station employs the printhead to print on a surface of the plastic cards.

An advantage of the present invention provides a thermal printhead that can print on pre-embossed cards without interference or obstruction of the pre-embossed regions of the card, such as text or pictures. Further, the method of the present invention allows for a more convenient way to process cards having pre-embossed text.

These and other various advantages and features of novelty, which characterize the invention, are pointed out in the following detailed description. For better understanding of the invention, its advantages, and the objects obtained by its use, reference should also be made to the drawings which form a further part hereof, and to accompanying descriptive matter, in which there are illustrated and described specific examples of an apparatus in accordance with the invention.

DETAILED DESCRIPTION OF THE PREFERRED EMBODIMENT

In the following description of the illustrated embodiments, reference is made to the accompanying drawings that form a part hereof, and in which is shown by way of illustration of the embodiments in which the invention may be practiced. It is to be understood that other embodiments may be utilized as structural changes may be made without departing from the spirit and scope of the present invention.

Figure 2:
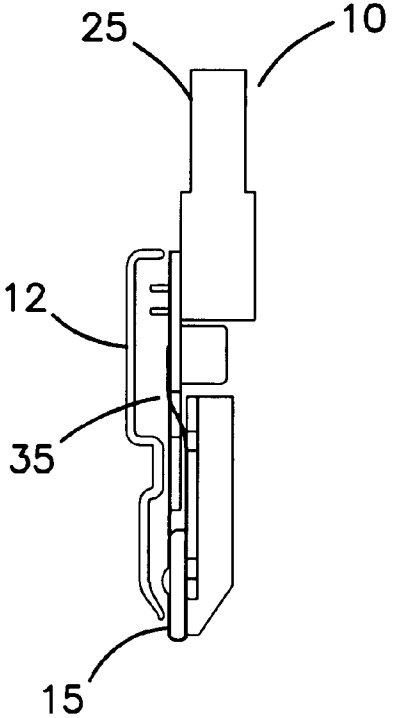
FIG. 2 represents an end view of the thermal printhead in FIG. 1 in accordance with the principles of the present invention.
Figure 1:
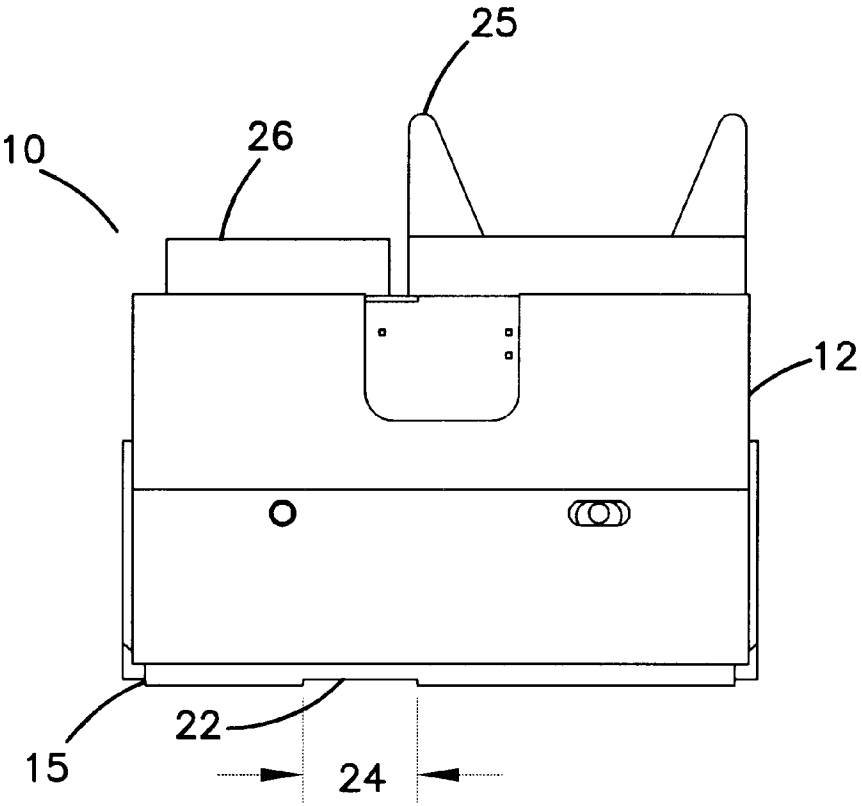
FIG. 1 represents a side view of one embodiment of a thermal printhead in accordance with the principles of the present invention.

FIGS. 1 and 2 represent one embodiment of a thermal printhead 10. The thermal printhead 10 includes a means for connecting to a data source 25 and a means for connecting to a power source 26 operatively connected with a data transfer means 35. Preferably, the means for connecting to a data source 25 is a communication port, and the means for connecting to a power source 26 is a power port. Preferably, the means for connecting to a data source 25 and the means for connecting to a power source 26 may be any suitable port, such as a pronged plug, so as to allow connection for transferring data and powering of the thermal printhead 10. Preferably, the means for connecting to a data source 25 enables image data such as pictures, text, and other images to be provided from a data source, such as a known control unit (not shown), to the data transfer means 35. It will be appreciated that a control unit may be any suitable control unit used in a printer employing thermal printheads. A frame 12 supports the means for connecting to a data source 25, the means for connecting to a power source 26 and data transfer means 35 in assembly of the thermal printhead 10 as a single unit. The thermal printhead 10 is structured such that it may contact substrates with embossed regions, such as embossed text on plastic cards. It will be appreciated that substrates other than plastic cards may be printed on using the thermal printhead 10.

Preferably, the embossed region of such cards may pass under the thermal printhead 10 during the printing process without obstructing printing on the card and without comprising contact of the printhead with the card. The data transfer means 35 is operatively connected with at least one elongated contact member 15 for contacting plastic cards and allowing transfer of the text and/or image data. At least one notch 22 is in communication with the contact surface of the elongated contact member, where the notch defines a gap in the contact surface. As best shown in FIG. 1, the elongated contact member 15 has a recess or notch 22 along a length of the elongated contact member 15. Preferably, the notch extends along the longitudinal axis of the elongated contact member 15, and is disposed on the surface of the elongated contact member 15. This notch or recess 22 may be applied using waterjet techniques. Preferably, the notch 22 includes a length 24. The length 24 is constructed such that it is at least long enough for an embossed region, such as text or pictures, to pass through a gap or recess created by the notch 22 and under the thermal printhead 10, where the rest of the elongated contact member 15 remains in contact with the card. It will be appreciated that other techniques suitable for applying a notch 22 may also be employed. The elongated contact member 15 may be made of, but is not limited to, a ceramic material having a conductive coating thereon.

Figure 8B:
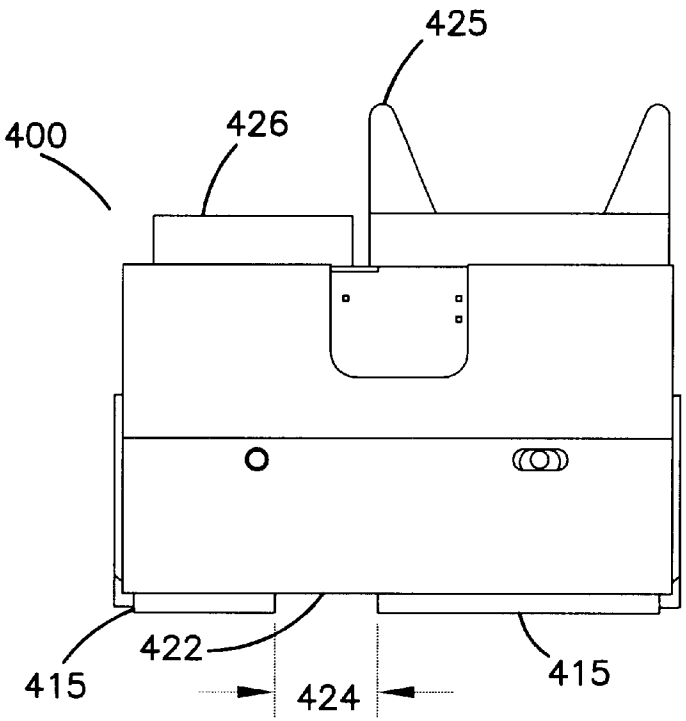
FIG. 8*b* represents a side view of another embodiment of a thermal printhead in accordance with the principles of the present invention.
Figure 8A:
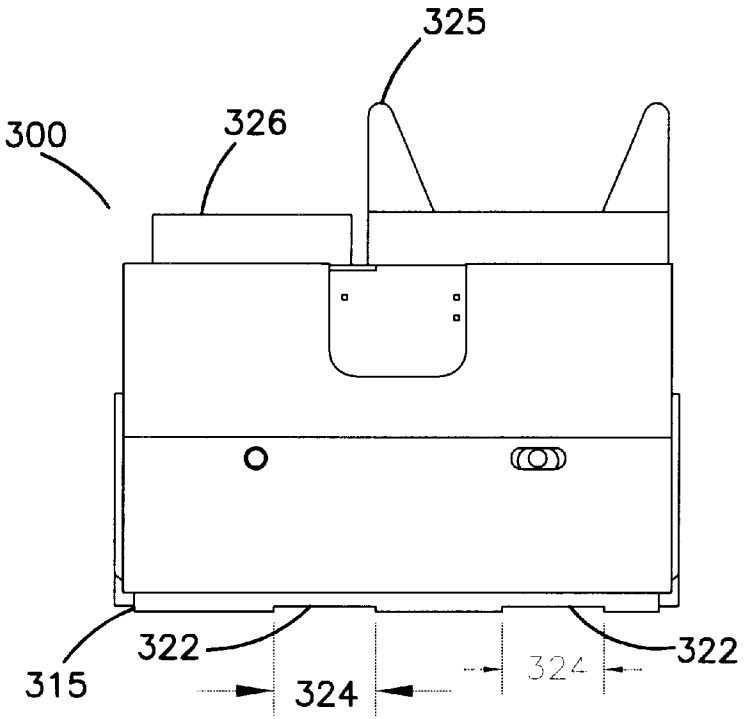
FIG. 8*a* represents a side view of one embodiment of a thermal printhead in accordance with the principles of the present invention.

In addition, a plurality of notches 22 may be applied to the elongated contact member 15 as needed for printing on particular plastic cards that may have multiple areas of embossed text. For example, FIG. 8*a* illustrates one preferred embodiment of a thermal printhead 300. The thermal printhead 300 is similar to the thermal printhead 10 in that a means for connecting to a data source 325 and a means for connecting to a power source 326 are provided. Further, an elongated contact member 315 is operatively connected with a data transfer means (not shown). A difference is illustrated in that the elongated contact member 315 employs a plurality of notches 322 having a length 324. As shown, the elongated contact member 315 employs two notches 322. It will be appreciated that more than two notches 322 may be employed. It also will be appreciated that each notch may differ in length from one another. Further, it will be appreciated the length, such as length 324 may vary as needed according to the size of the pre-embossed text or picture on the card.

Figure 3:
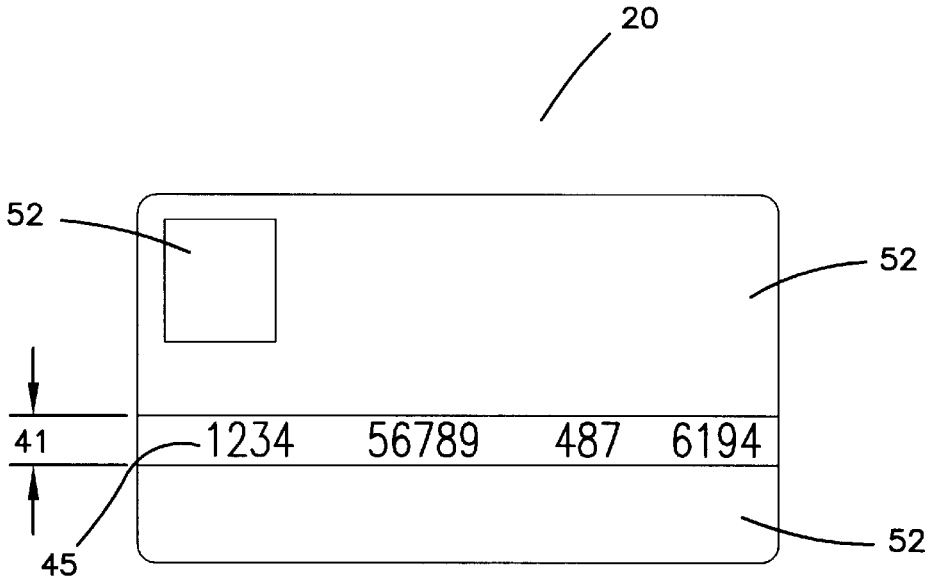
FIG. 3 represents one embodiment of a pre-embossed card with printed images thereon in accordance with the principles of the present invention.

FIG. 3 illustrates one preferred embodiment of an embossed plastic card 20 having images 52 printed thereon. The embossed plastic card 20 may be a credit card, identification card, driver's license, access card, debit card, insurance card, etc. As can be seen in FIG. 3, images 52, such as pictures, photos, and other designs, are printed on both sides of the pre-embossed text 45, shown as numbers in FIG. 3. Other types of pre-embossed forms may be employed, such as letters or even picture outlines, for instance, logos, etc. A width 41 is shown as a size dimension for the pre-embossed text 45. The width 41 of the embossed card 20 may generally correspond to the notch length, for instance notch length 24 as shown in FIG. 1. In this configuration, the pre-embossed text 45 can pass under a notch, such as notch 22, 322 and 422 (FIG. 8*b*) of a thermal printhead during printing. Preferably, the width 41 is not larger in dimension than the length, 24, 324, 424 (FIG. 8*b*) created by a notch. Further, the width 41 and also the position of the pre-embossed text may be in accordance with conventional ISO standards that define location and size for embossed text on a plastic card. Likewise a notch in the thermal printhead may be accordingly sized along these conventional standards. Employing a printhead 10 as illustrated in FIGS. 1, 2 and 8*a–b* can allow printing on at least both sides of the pre-embossed regions, such as pre-embossed text 45 in FIG. 3 of a plastic card.

Figure 6:
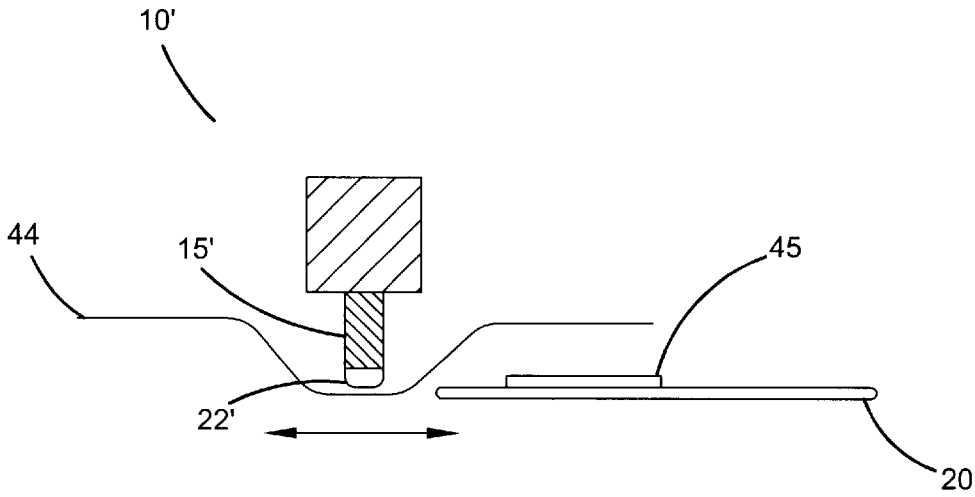
FIG. 6 represents a schematic view of one embodiment of a pre-embossed card passing under a thermal printhead in cross-section in accordance with the principles of the present invention.

FIG. 6 illustrates a schematic of one preferred embodiment of the embossed plastic card 20 passing under the elongated contact member 15' of the thermal printhead 10'. As shown, the pre-embossed text 45 can pass under the elongated contact member 15' at the notch position 22'. It will be appreciated that the notch position 22' is sized so as to enable the passing of the pre-embossed text 45 therethrough. Preferably, a thermal transfer ribbon 44 passes across the face of the printhead 10', which remains stationary, and the elongated contact member 15' in the printhead 10' is energized where the heat produced activates an ink coating on the ribbon, transferring ink onto the surface of the card. It will be appreciated that substrates other than plastic cards may be printed on using the thermal printhead 10'. Preferably, the unembossed surface of the card is printed on. It will be appreciated that the notch 22' of the elongated contact member 15' may contact the pre-embossed text 45 and print on the embossed text 45, while still allowing the embossed card to pass under the thermal printhead 10'.

In addition, multiple elongated contact members may be attached to a common printhead where each elongated contact member could be spaced a determined distance from one another to create at least one notch resembling a gap or groove for the embossed region of a plastic card to pass between notch of the elongated contact members and under the printhead. Preferably the gap or groove created by the notch extends along the longitudinal axis of the contact surface of the elongated contact member and is in communication therewith. For example, FIG. 8*b* illustrates one preferred embodiment of a thermal printhead 400. As above, the thermal printhead 400 is similar to the thermal printhead 10 in that a means for connecting to a data source 425 and a means for connecting to a power source 426 are provided. Further, an elongated contact member 415 is operatively connected with a data transfer means (not shown). A difference is illustrated in that a plurality of elongated contact members 415 are employed that are spaced apart to create a notch 422 with a length 424. As shown in FIG. 8*b*, two elongated contact members are illustrated creating one notch 422. It will be appreciated that more than two elongated members creating more than one notch may be employed. It also will be appreciated that each notch may differ in length from one another. Further, it will be appreciated the length, such as length 424 may vary as needed according to the size of the pre-embossed text or picture on the card.

Alternatively, it will be appreciated that multiple thermal printheads without notches may be employed for printing on pre-embossed cards (not shown). These thermal printheads may vary in length. Similar to above, these printheads also would be positioned such that printing on both sides of pre-embossed text could be allowed. However, employing multiple printheads may be disadvantageous, as multiple components including data communication and power source parts may be required thereby complicating the system. Further, skewed data transfer may occur as a result of the multiple components.

Figure 4:
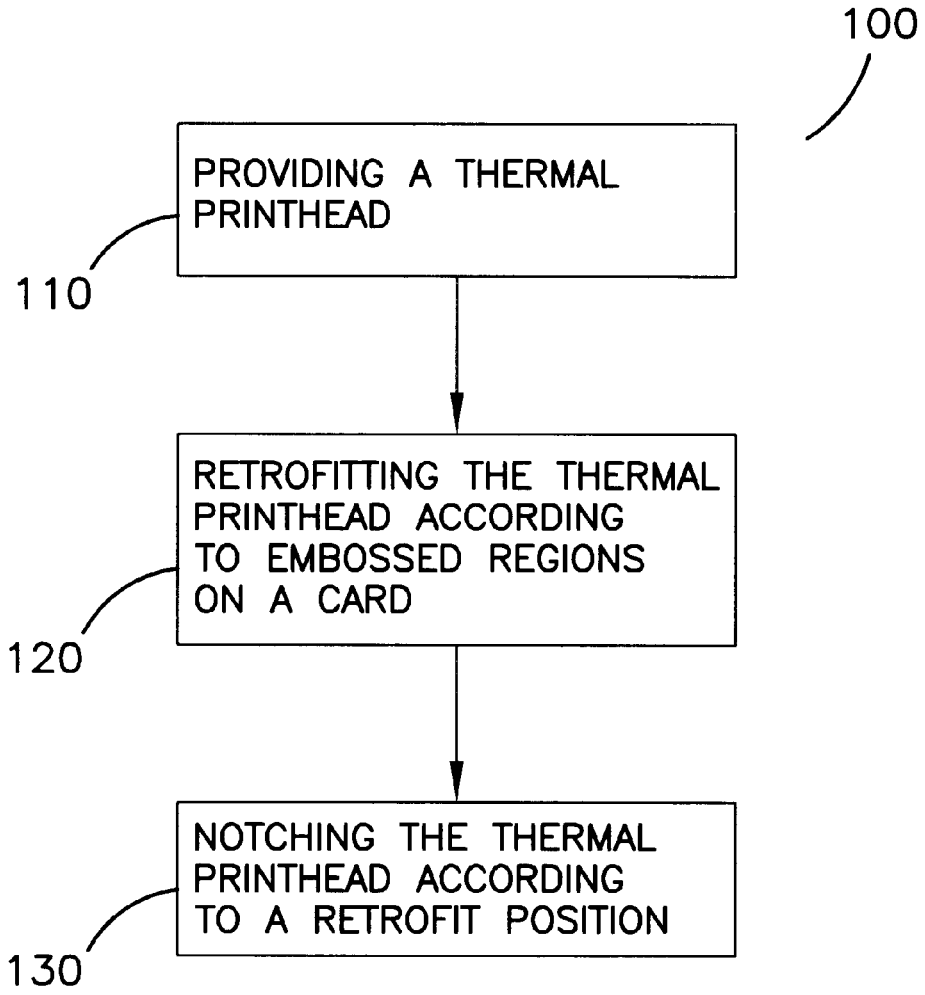
FIG. 4 represents a flow diagram of one embodiment of a method for making a thermal printhead in accordance with the present invention.

FIG. 4 outlines one preferred embodiment of a method 100 for making a thermal printhead. The method 100 includes providing a thermal printhead 110. The thermal printhead is similar to the thermal printhead 10, which includes a means for connecting to a data source 25 and a means for connecting to a power source 26, and a data transfer means 35 for transferring data from the data source. Preferably as defined above, the means for connecting to a data source 25 is a data communication port, and the means for connecting to a power source 26 is a power port. Further, at least one elongated contact member 15 is operatively connected with the data transfer means 35 for contacting a plastic card 20.

Preferably, the elongated member 15 of the thermal printhead 10 is retrofitted 120 to embossed regions, for instance the pre-embossed text 45 on the plastic card 20, in order to obtain a position where a notch 22 is to be located. After retrofitting 120 the thermal printhead to the plastic card 20, a step of notching the thermal printhead 130 is performed, thereby making a groove or recess at least the size of the pre-embossed text allowing the thermal printhead to print on both sides of the pre-embossed text of the plastic card. The notch is made according to the retrofit position obtained in step 120. It will be appreciated that the retrofit position may be in accordance with conventional standards for embossed text on plastic cards, such as ISO standards. In this configuration an existing thermal printhead may be retrofitted to accommodate pre-embossed cards that may or may not be in accordance with conventional ISO standards.

Figure 5:
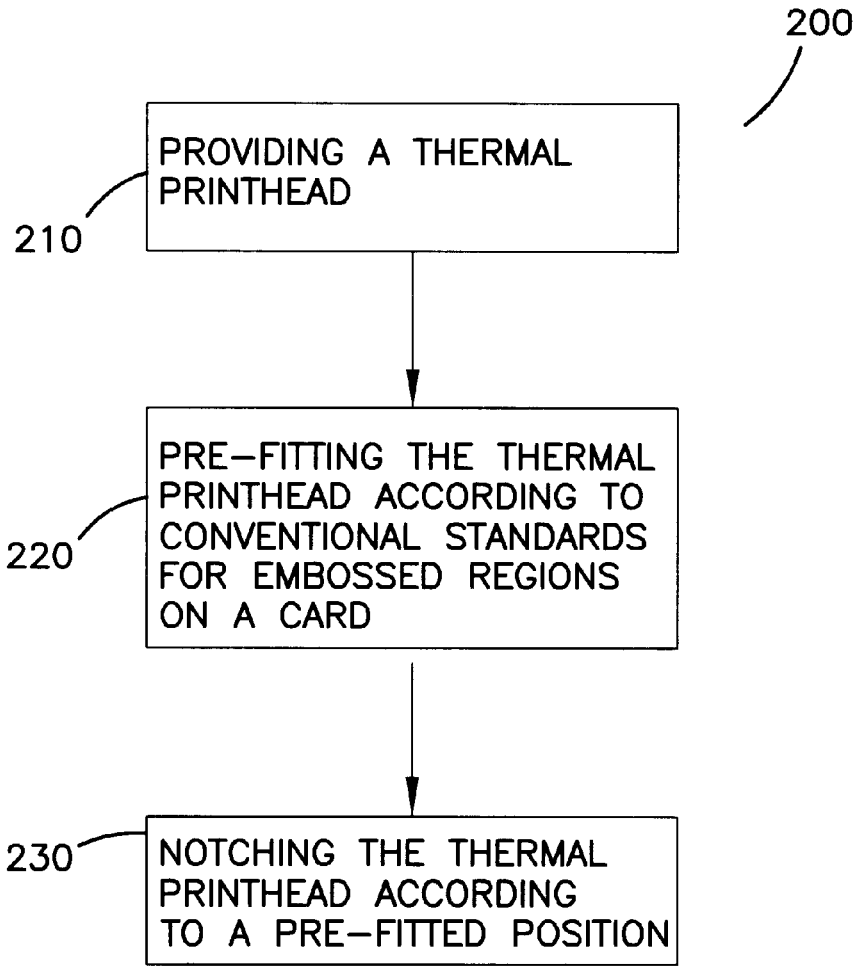
FIG. 5 represents a flow diagram of one embodiment for another method for making a thermal printhead in accordance with the present invention.

FIG. 5 outlines another embodiment of a method 200 for making a thermal printhead. The method 220 includes providing a thermal printhead similar to thermal printhead 10. As defined above, the thermal printhead 10 includes a means for connecting to a data source 25 and a means for connecting to a power source 26, and a data transfer means 35 for transferring image data from the data source. Further, at least one elongated contact member 15 is operatively connected with the data transfer means 35 for contacting a plastic card 20.

Preferably, the thermal printhead is pre-fitted 220 in accordance with conventional standards for embossed texts on cards. For example, at least one of these pre-fitted notches can be measured in accordance with ISO standards defining size and position for embossed text on a plastic card. A notch 22 is formed in communication with the elongated contact member of the thermal printhead 230 during the manufacture of the thermal printhead according to these known positions or known ISO specifications for size and position. Basically, at least one notch 22 or groove having the size of the pre-embossed text is formed and positioned according to these conventional standards. In this configuration, the thermal printhead 10 can print on the surface of the plastic card 20 where there is no pre-embossed text, and allow a region where there is pre-embossed text to pass under the thermal printhead 10 at the notch 22. It will be appreciated that substrates other than plastic cards may be printed on using the thermal printhead.

Figure 7:
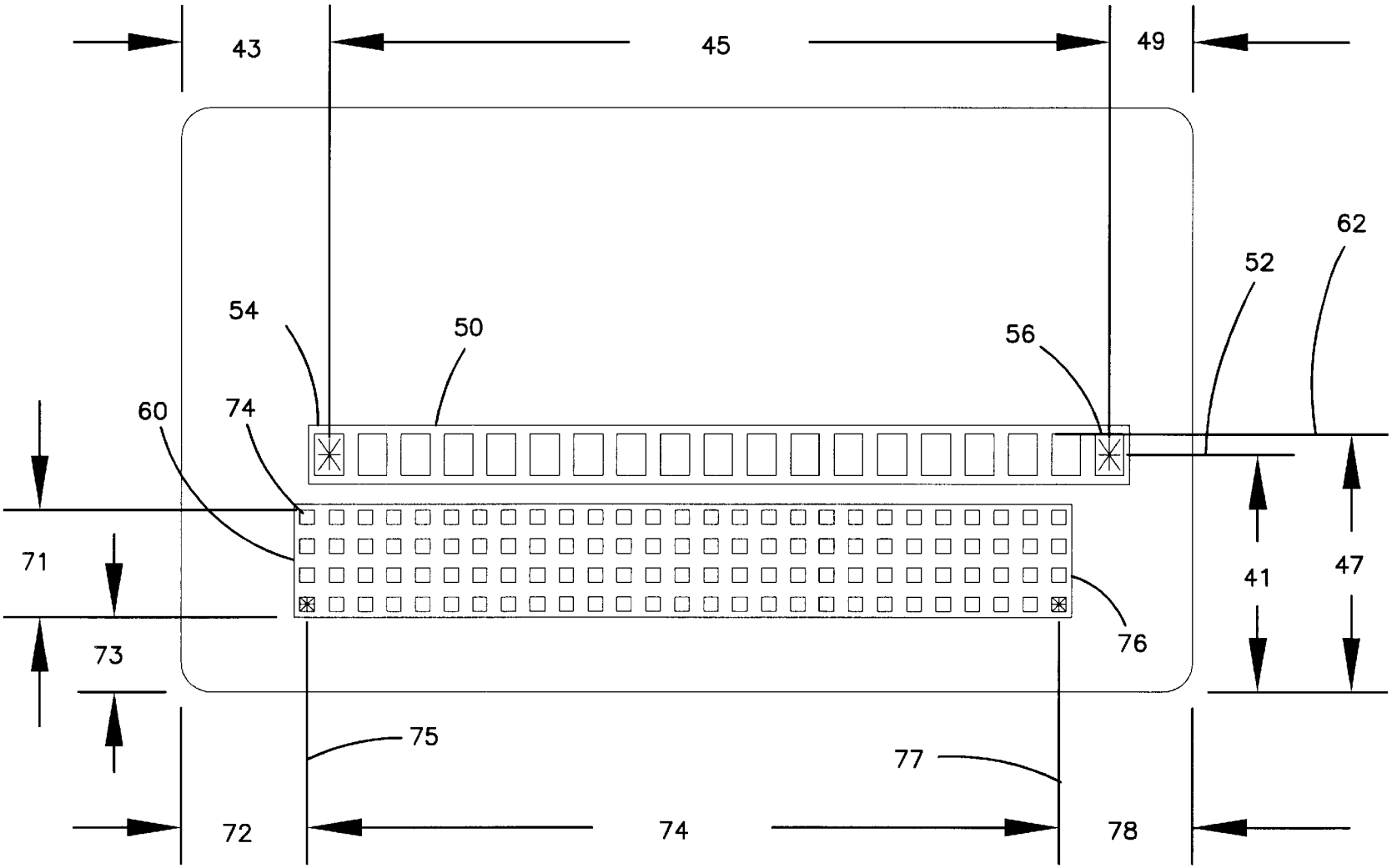
FIG. 7 represents one embodiment of a conventional standard for embossed text on plastic cards.

With regard to ISO standards, FIG. 7 illustrates ISO standards and known positions and sizes for embossed text. For an identification number line 50, a maximum of 19 characters can be used at a nominal spacing of 7 characters per inch. The centerline 52 of the identification number line 50 may be located a distance 41 of 0.843 inches ±0.005 inches from the bottom edge of the card. A distance 43 between the centerline of the first character position 54 and the left edge of the card may be 0.401 inches ±0.010 inches, and a distance 45 between the centerline of the first character position 54 and, if needed, the 19th character position 56 should not exceed 2.571 inches ±0.030 inches. A distance 49 between the 19th character position (if needed) and the right edge of the card may be about 0.403 inches. Further, a maximum distance 47 from a top line 62 of the identification number line 50 from the bottom edge of the card may be 0.946 inches.

For other card holder information such as names and addresses, the following standards apply. A maximum height 71 of the name and address line 60 may be 0.572 inches and located under the identification number line 50. A distance 73 between the bottom of the name and address information line 60 and the bottom edge of the card may be 0.095 inches to 0.130 inches. A distance 72 between the centerline 75 of the first character position 74 of each line in the name and address information and the left edge of the card may be 0.301 inches ±0.010 inches. Further, a distance 78 between the centerline 75 of the first character position and (if needed) the centerline 77 of the 27th character position 76 should not exceed 2.600 inches ±0.030. A distance 79 between the 27th character position (if needed) and the right edge of the card may be about 0.474 inches. It will be appreciated that the thermal printhead 10 can be fitted to accommodate these standard positions and sizes for embossed regions on a card.

In addition, it will be appreciated that a plurality of notches (i.e. FIG. 8*a*) with differing sizes may be applied to a thermal printhead, as necessary, in the printing of plastic cards that may have multiple areas of embossed text and different sizes of embossed text or regions. Also as discussed above, a plurality of elongated members spaced a determined distance apart may be attached to a common thermal printhead (i.e. FIG. 8*b*).

As card issuing institutions pre-emboss cards before sending them to a printing station, such as for security purposes, the present invention provides an advantage of a thermal printhead that can allow printing on pre-embossed plastic cards. The printhead of the present invention is not interfered with or obstructed by pre-embossed text during the printing process. The methods of the present invention allow for a more convenient way to process cards having pre-embossed text. Existing printheads may be inexpensively modified or retrofitted with a notch to perform printing on pre-embossed cards.

Having described the embodiments of the present invention, modifications and equivalents may occur to one skilled in the art. It is intended that such modifications and equivalents shall be included with the scope of the invention. Since many embodiments of the invention can be made without departing from the spirit and scope of the invention, the invention resides in the claims hereinafter appended.

We claim:

1. A thermal printhead for printing on a substrate having an embossed region, comprising:

a means for connecting to a data source;

a means for connecting to a power source;

a data transfer means operatively connected with said means for connecting to a data source; and at least one elongated contact member operatively connected with said data transfer means and said means for connecting to a power source, said elongated contact member including a contact surface and at least one notch in communication with said contact surface, said notch defining a gap in said contact surface, said contact surface being contactable on said substrate such that said notch enabling said embossed region of said substrate to pass under said notch;

whereby during printing on said substrate, said means for connecting to a power source powers said elongated contact member so as to heat said elongated contact member, and said data transfer means transfers data through said elongated contact member.

2. The thermal printhead according to claim 1, wherein said elongated contact member including a plurality of notches disposed along said contact surface.

3. The thermal printhead according to claim 2, wherein said plurality of notches each having a length differing from one another.

4. The thermal printhead according to claim 1, wherein said length of said notch is a retrofitted notch.

5. The thermal printhead according to claim 1, wherein said length of said notch is a pre-fitted notch.

6. The thermal printhead according to claim 1, further comprising a plurality of elongated contact members commonly connected to said data transfer means, said elongated contact members being spaced apart a distance to form said at least one notch between said elongated contact members.

7. The thermal printhead according to claim 1, wherein said notch having a length extending along a longitudinal axis defined by said contact surface.

8. The thermal printhead according to claim 1, wherein said elongated contact member including a conductive film, said conductive film being contactable with said substrate.

9. The thermal printhead according to claim 1, wherein said elongated contact member being a ceramic material.

10. A printer including a thermal printhead for printing on a plastic card having embossed regions, said thermal printhead comprising:

a means for connecting to a data source;

a means for connecting to a power source;

a data transfer means operatively connected with said means for connecting to a data source; and at least one elongated contact member operatively connected with said data transfer means and said means for connecting to a power source, said elongated contact member including a contact surface and at least one notch in communication with said contact surface, said notch defining a gap in said contact surface, said contact surface being contactable on said card such that said notch enabling said embossed region of said card to pass under said notch;

whereby during printing on said card, said means for connecting to a power source powers said elongated contact member so as to heat said elongated contact member, and said data transfer means transfers data through said elongated contact member.

11. The printer according to claim 10, wherein said elongated contact member including a plurality of notches disposed along said contact surface.

12. The printer according to claim 11, wherein said plurality of notches each having a length differing from one another.

13. The printer according to claim 10, further comprising a plurality of elongated contact members commonly connected to said data transfer means, said elongated contact members being spaced apart a distance to form said at least one notch between said elongated contact members.

14. The printer according to claim 10, wherein said notch having a length extending along a longitudinal axis defined by said contact surface.

15. The printer according to claim 10, wherein said elongated contact member including a conductive film, said conductive film being contactable with said card.

16. The printer according to claim 10, wherein said elongated contact member being a ceramic material.

17. A method for making a thermal printhead for printing on embossed cards, comprising:

providing a thermal printhead including a means for connecting to a data source, a means for connecting to a power source, a data transfer means operatively connected with said means for connecting to a data source, and at least one elongated contact member operatively connected with said data transfer means, said elongated contact member including a contact surface for contacting a surface of said embossed card;

obtaining at least one notch position;

forming at least one notch on said contact surface according to said obtained notch position, said notch in communication with said contact surface, said notch defining a gap in said contact surface.

18. The method for making a thermal printhead according to claim 17, wherein said step of obtaining at least one notch position including retrofitting said thermal printhead to obtain said notch position according to said embossed region of said embossed card.

19. The method for making a thermal printhead according to claim 17, wherein said step of obtaining at least one notch position including pre-fitting said thermal printhead to obtain said notch position according to a conventional standard for position and size of said embossed region on said embossed card.

20. A method for printing on a embossed plastic card, comprising:

providing a printer having a thermal printhead including a means for connecting to a data source, a means for connecting to a power source, a data transfer means operatively connected with said means for connecting to a data source, and at least one elongated contact member operatively connected with said data transfer means, said elongated contact member including a contact surface for contacting a surface of said plastic card and a notch in communication with said contact surface, said notch defining a gap in said contact surface;

contacting said plastic card using said thermal printhead;

printing on a surface of said plastic card such that an embossed region of said plastic card passes under said notch.

* * * * *

UNITED STATES PATENT AND TRADEMARK OFFICE

CERTIFICATE OF CORRECTION

PATENT NO. : 6,781,614 B2 
DATED : August 24, 2004
INVENTOR(S) : Gary L. Pearson and Mathew D. PeKarna It is certified that error appears in the above-identified patent and that said Letters Patent is hereby corrected as shown below:

Title page,
Item [75], Inventors, "PeKarna D. Mathew" should read -- Mathew D. PeKarna --
Item [57], ABSTRACT,
Line 4, "a means" should read -- a device --
Line 4, "source, means" should read -- source, a device --
Line 5, "transfer means" should read -- transfer device --

Signed and Sealed this

Twenty-sixth Day of July, 2005

JON W. DUDAS
*Director of the United States Patent and Trademark Office*